United States Patent [19]

Terral

[11] 4,002,203

[45] Jan. 11, 1977

[54] WELL INSTALLATION

[75] Inventor: Ben David Terral, Houston, Tex.

[73] Assignee: Camco, Incorporated

[22] Filed: Sept. 8, 1975

[21] Appl. No.: 610,970

[52] U.S. Cl. ..... 166/117.5

[51] Int. Cl.[2] ..... E21B 23/02

[58] Field of Search ..... 166/117.5, 224 R, 242

[56] References Cited

UNITED STATES PATENTS

| | | | |
|---|---|---|---|
| 2,942,671 | 6/1960 | Schramm | 166/242 |
| 2,948,341 | 8/1960 | Fredd | 166/224 |
| 2,988,146 | 6/1961 | Fredd | 166/117.5 |
| 3,796,259 | 3/1974 | Outhouse | 166/117.5 |
| 3,807,498 | 4/1974 | Terral et al. | 166/117.5 |
| 3,827,490 | 8/1974 | Moore, Jr. et al. | 166/117.5 |
| 3,891,032 | 6/1975 | Tausch et al. | 166/117.5 |
| 3,899,025 | 8/1975 | Dinning | 166/117.5 |

*Primary Examiner*—James A. Leppink
*Attorney, Agent, or Firm*—Fulbright & Jaworski

[57] ABSTRACT

A well installation having a locator tool for installing or removing well apparatus into or from a well sub in a well tubing. The locator tool moves through the well tubing, such as by wireline or fluid pumpdown. One feature is the actuation of the locator tool by a single downward and upward movement of the locator tool by engaging an upward shoulder in a well sub thereby avoiding multiple reciprocation of the well tool which is particularly disadvantageous in pumpdown operations. Another feature is providing a distinctive configuration on the well tool and a corresponding coacting configuration on one sub whereby the well tool may be selectively actuated in the one well sub in a well tubing having a plurality of subs. Another feature is the provision of coacting orientation means between the locator tool and a well sub for orienting a well apparatus in the well tubing. Another feature is the provision of a selective configuration in the well sub by a narrow selective configured slot which avoids the use of annular grooves which might interfere with other well operations. A well mandrel and kickover tool is provided for installing or removing flow control devices from the mandrel in which one or more of the above-mentioned features is provided.

12 Claims, 11 Drawing Figures

WELL INSTALLATION

BACKGROUND OF THE INVENTION

The use of well installations having orienting means for selectively installing or removing well apparatus from a well sub in well tubing is old as illustrated in U.S. Pat. Nos. 3,827,490; 2,942,671; 2,948,341; and 2,988,146. However, in the prior art in order to install or remove well apparatus selectively in one of a plurality of well subs in a well tubing, multiple reciprocation of the well locator tool in the tubing is required. However, multiple reciprocation of a well tool at definite locations in a tubing, particularly in a hydraulic pumpdown system, is difficult to perform and is therefore undesirable. One feature of the present invention is the actuation of a well locator tool in a well tubing by a single down and up movement by engaging an upwardly directed shoulder in the well tubing thereby avoiding multiple reciprocation of the locator tool. Another feature of the present invention is the provision of providing different configurations in a plurality of well subs whereby a particular well tool will selectively coact only with a selected well sub. Another feature of the present invention is that the selectivity is provided by a configuration of ridges and valleys in a slot in the well sub which avoids providing obstructions in the well tubing upon which other well equipment having annular shoulders may engage. In addition, the present invention provides a well installation having various other improvements in which well apparatus is selectively installed or removed from one of a plurality of well subs in the well tubing.

SUMMARY

The present invention is directed to a well installation system having an improved well locator tool for selectively installing or removing well equipment from one of a plurality of improved well subs in the well tubing.

One object of the present invention is the provision of a well locator tool having a downwardly directed actuating shoulder for engaging an upwardly directed actuating shoulder of a well sub whereby the locator tool may be actuated to install or remove well apparatus in a sub by a simple downward and upward movement which can be accomplished either by a wireline or pumpdown operation.

Another object of the present invention is the provision of a particular configuration of at least one ridge and one valley adjacent the actuating shoulder of the locator tool which will coact only with a corresponding mating surface in one of the well subs whereby the locator tool will be selectively actuated only by the sub having the corresponding coacting mating surfaces.

Yet a still further object of the present invention is the provision of particular configurations of ridges and valleys to provide a selective actuation of a well locator tool in a particular sub in which the configuration is formed in a vertical slot which is provided in combination with an orienting sleeve thereby avoiding an annular shoulder in the well sub which might undesirably engage other annular shoulders from other well equipment.

Yet still a further object of the present invention is the provision of a well locator tool for coacting with a well sub positioned in a well tubing in which the tool has a body having connection means for moving the tools through the tubing and connection means for supporting a well apparatus therefrom in which locating means are connected to the body for coacting with an orienting sleeve and slot in a sub and in which a downwardly actuating shoulder is connected to the body for engaging an upwardly directed actuating shoulder of a sub. Preferably, spring means are provided yieldably urging the actuating shoulder outwardly away from the body and a downwardly tapered surface is provided on the top of the acutating shoulder whereby the tool may be raised in the well tubing without catching on obstructions. Preferably, the downwardly actuating shoulder of the well tool is provided for allowing longitudinal movement between the shoulder and the body but releasing means initially prevent such longitudinal movement for allowing the locator tool to selectively engage the proper well sub after which the releasing means may be disengaged to allow further downward movement of the body for setting or removing a well apparatus carried by the body.

Yet a still further object of the present invention is a well locator tool in which means are provided for yieldably resisting longitudinal movement between the body and the actuating shoulder for providing a timed delay in which such means may include a fluid chamber, a piston positioned in the chamber and a restricted orifice in communication with the chamber and bypassing the piston.

A further object of the present invention is the provision of a well sub for use in a well installation for actuating a well locator tool in which the sub has a tubular housing having connection means for connecting the housing in a well tubing and an orienting sleeve positioned in the housing having a downwardly extending guide surface on the top of the sleeve, a slot extending downwardly from the guide surface for orienting the locating means of a well tool, and an upwardly directed actuating shoulder adjacent the sleeve for engaging a downwardly directed actuating shoulder of the locator tool. Preferably, the actuating shoulder of the well sub includes a particular configuration of at least one ridge and at least one valley which will coact only with corresponding mating surfaces on a particular well locator tool and preferably the actuating shoulder of the well sub is vertically aligned with and positioned below the guide surface and has substantially the same width as the slot in the orientation sleeve.

Another object of the present invention is providing a well mandrel for connection in a well tubing having a bore extending through the body and a pocket in the body for receiving a flow control device in which an orientation means is provided in the mandrel body above the pocket for orienting and actuating a kickover tool on a downward movement of the kickover tool through the mandrel in which the orienting sleeve has a downwardly extending guide surface on the top of the sleeve and a slot extending downwardly from the guide surface for orienting a kickover tool with an upwardly directed actuating shoulder adjacent the sleeve and having a particular configuration of at least one valley and one ridge in the body adjacent the upwardly directed shoulder which will accept only a kickover tool having a member with a coacting configuration.

Still a further object is the provision of a kickover tool for use with a mandrel in a well installation in which the tool has a body having connection means for moving the tool through a well tubing, locating means connected to the kickover body for coacting with an orienting sleeve of a mandrel, a downwardly directed actuating shoulder connected to the kickover body for engaging the upwardly actuating shoulder of a mandrel, kickover means connected to and supported by the body with means longitudinally movable relative to the body initially holding the kickover means aligned with the body, and releasing means connected between the longitudinal movable means and the body for releasing the kickover means, and in which a predetermined configuration is provided adjacent the kickover actuating shoulder which will coact only with a mandrel having a coacting configuration.

Other and further features and advantages will be readily apparent from the following description of preferred embodiments of the invention.

DESCRIPTION OF THE PREFERRED EMBODIMENTS

Figure 1A:
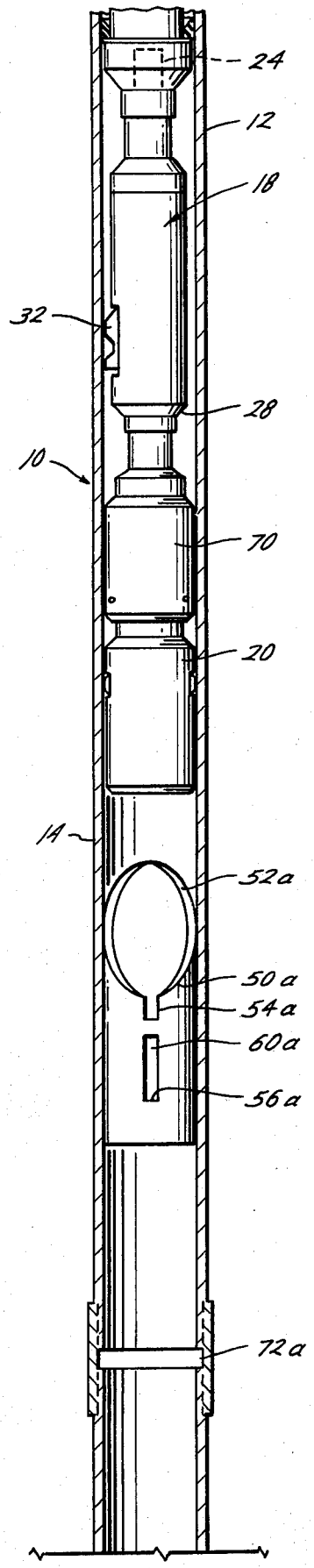
FIGS. 1A and 1B taken together are directed to a well installation shown in elevational view, partly in cross section, illustrating a well installation having a plurality of well subs in which a well locator tool is provided to install a well apparatus in a selected one of the well subs.
Figure 1B:
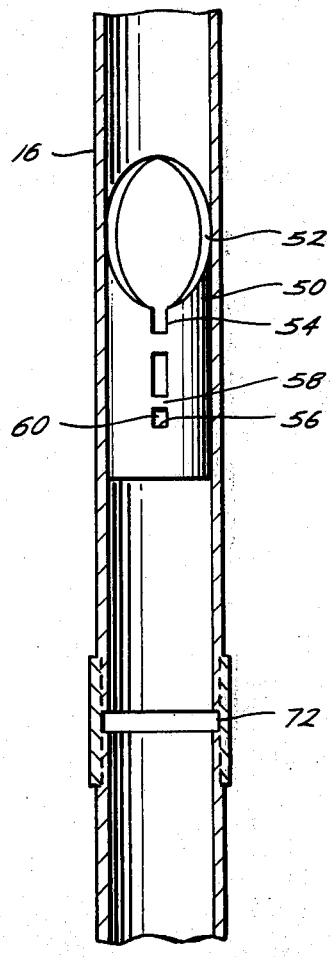

Referring now to the drawings, and particularly to FIGS. 1A and 1B, a well installation is shown generally indicated by the reference numeral 10 which generally includes a well tubing 12 having a plurality of well subs, shown for purposes of illustration at two, 14 and 16, and a well locator tool generally indicated by the reference numeral 18 shown in position for selectively installing a well apparatus 20, which for example only may be a Camco Z-lock which normally supports other equipment (not shown) in one of the subs 14 or 16.

Referring now to FIGS. 1A, 1B, 2A and 2B, the well locator tool 18 includes a body 22 having a connection means at one end such as threads 24 for connecting to suitable means for moving the tool 18 through the well tubing 10, such as by pumpdown locomotive 26, although a conventional wireline could be used if desired. In addition, the body 22 includes connection means for supporting the well apparatus 20 such as a threaded connection 28.

The locator tool 18 includes a locating assembly 30 having a locating means such as locating finger 32 which is yieldably urged outwardly by a spring 34 through a window 36 in the body 22 for coacting with and locating a particular sub, such as sub 16. The key 32 may include a downwardly tapered surface such as surface 38 whereby the tool 18 may be easily raised in the tubing 12 without catching on downwardly directed shoulders in the tubing 12. While unnecessary to the embodiment of the well locator tool illustrated in FIGS. 1A, 1B, 2A, 2B, 3A and 3B, the locating assembly 30 is preferably longitudinally movable relative to the body 22 and is releasably connected thereto such as by a shear pin 31 for other uses of the tool 18, such as will be more fully discussed in connection with the embodiments of FIGS. 5–8. The finger 32 is pivotally connected to the locating assembly 30 by a pivot pin 33.

While it is generally easy to raise and lower the well locator tool 18 and accurately position the tool in the tubing 12 by a conventional wireline for installing or removing well apparatus, such as lock 20, it becomes more difficult to position and manipulate the well tool 18 when it is being moved through the tubing 12 by hydraulic fluid acting on the locomotive 26. One feature of the present invention is the provision of means for locating, and installing or removing a well apparatus by the locator tool 18 by means of only a downward and upward movement of the tool 18 in the well tubing 12 which can be satisfactorily obtained by means of hydraulic fluid movement of the well tool 22. The well tool 18 is provided with a downwardly directed actuating shoulder, such as shoulder 40 positioned on the locator finger 32 although the shoulder 40 can be provided on the tool 18 in other ways.

The shoulder 40 will locate an upwardly directed shoulder in the well tubing 12 for actuating a well apparatus 20 on a downward movement of the well locator tool 18 through the tubing 12. However, it is desirable that the shoulder 40 will only be engaged and actuated at a selected location in the well tubing 12. Therefore, the shoulder 40 is provided with an adjacent configuration which will only coact with a corresponding coacting configuration at the desired location in the tubing 12. Such selectivity is provided by a configuration having at least one ridge 42 and at least one valley 44 which will mate in a coacting configuration, such as in sub 16, before the actuating shoulder 40 may be outwardly extended by the spring 34 to mate with the desired upwardly actuating shoulder 56 of the desired well sub 16. The key 32 may have additional ridges and valleys for providing a greater range of selectivity, such as ridge 45 and tapered surface 38 which acts as a valley.

The well subs 14 and 16, are tubular housings having connection means such as threads at each end for connecting them in the well tubing 12. Each of the well subs includes an orienting sleeve with the sub 16 having an orienting sleeve 50 having a downwardly extending guide surface 52 on the top of the sleeve 50 and a slot 54 extending downwardly from the low point of the guide surface 52 for orienting the locating finger 32 of the well locator tool 18. In addition, the well sub 16 includes an upwardly directed actuating shoulder 56 which, while it may be above or below the sleeve 50, depending upon the location of the actuating shoulder 40 of the well tool 18, is preferably positioned below the guide surface 52 and the slot 54. While the shoulder 56 may be annular, this is not the preferred embodiment as it creates additional annular shoulders in the well tubing 12 which may engage, catch, or trip other types of tools. Therefore, it is preferable that the shoulder 56 be of substantially the same width as the slot 54 and will therefore accept only an actuating mechanism of the width of the locator key 32 and will avoid tripping other annular types of mechanisms. Therefore, by providing the combination of the orienting sleeve 50 and the upwardly directed actuating shoulder 56 a mechanism is provided which will accept the well locator tool 18 but which will not interfere with other well mechanisms.

Figure 4:
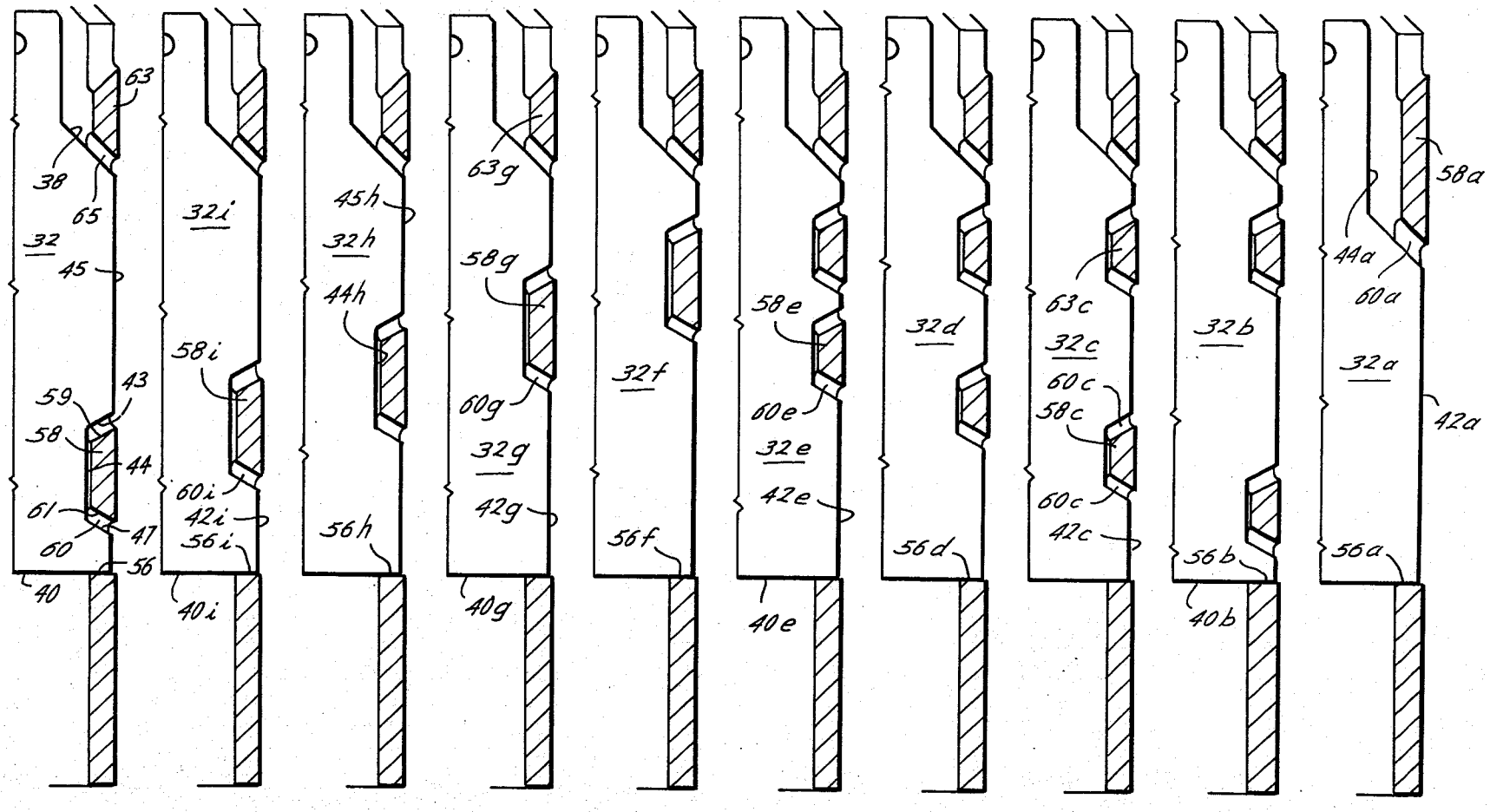

The well sub 14 has a similar orientation sleeve 50*a*, guide surface 52*a*, slot 54*a*, and upwardly directed shoulder 56*a*. However, in order to insure that the well locator tool 18 will locate and be actuated in only one of the subs, such as such 16, a coacting configuration is provided in the sub 16 which will accept the configuration of the locator key 32 consisting of its actuating shoulder 40, valley 44 and ridge 42. Thus, sub 16 includes a profile or configuration positioned relative to its upwardly directed shoulder 56 such as ridge 58 and valley 60 with the ridge 58 positioned to be in register with valley 44 of the key 32 and the valley 60 of the sub 16 being in register with the ridge 42 of the key 32 whereby the key 32 may be urged outwardly by the spring 30 to allow the actuating shoulder 40 to engage the upwardly actuating shoulder 56 of the well sub 16. While only a single ridge 58 and valley 60 is required, additional ridge 63 and valley 65 provide a greater range of selectivity and coact with shoulder 38 and ridge 45 of the key 32. However, the well sub 14 has a ridge 58*a* and a valley 60*a* which is positioned relative to the upwardly actuating shoulder 56*a* which are positioned so as to not to accept the locator key 32 of the well locator tool 18. Of course, by properly configuring the outer profile of the locator key 32, the well locator tool 18 can be made to be selectively actuated in the sub 14 instead of the sub 16. For example only, and referring to FIG. 4, ten different coacting configurations between a locator key and a sub are shown. It is to be noted that each of the keys and subs includes at least one coacting valley and ridge. However, the valleys and ridges between the keys 32, 32*a*, 32*b*, 32*c*, 32*d*, 32*e*, 32*f*, 32*g*, 32*h* and 32*i* and their coacting subs are positioned whereby the keys will selectively engage only a single one of the subs. Therefore, in order to install or remove a well apparatus from a selected sub in the well tubing 12, the well locator tool 18 is merely provided with the desired key 32 through 32*i*. Preferably, it is noted that each of the ridges 58 through 58*i* in the sub are provided with tapering surfaces which coact with corresponding tapered surfaces in the keys 32 through 32*i* to insure that the keys, 32, as the well tool 18 is raised in the tubing 12, will move towards the body 22 and will not engage any interfering shoulders on upward movement. Furthermore, it is preferable that the only shoulders directed upwardly are the actuating shoulders 56 through 56*i* whereby the subs avoid interferences with other well devices. Thus, the ridge 58 on the sub 16, as best seen in the left most view of FIG. 4, includes an upper taper 59 and a lower taper 61. In addition, the key 32 includes tapers 43 above key valley 44 and a taper 47 at the bottom of key valley 44 which coacts with the tapers 59 and 61 of the coacting ridge 58.

Figure 2A:
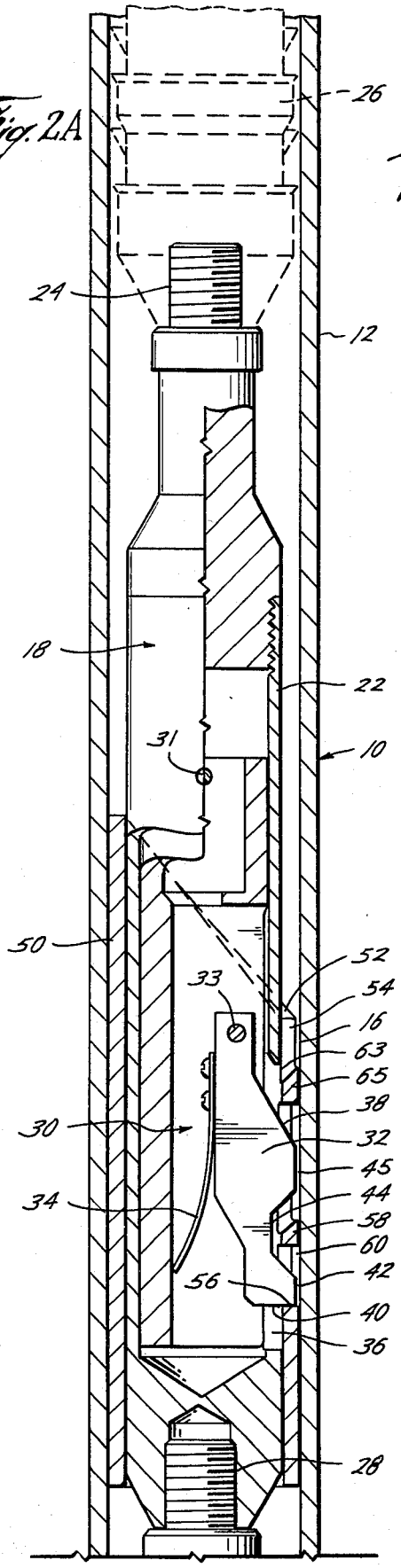
FIGS. 2A and 2B are enlarged elevational views, in cross section, illustrating the well locator tool of FIG. 1A coacting with one of the well subs for positioning the well apparatus.
Figure 2B:
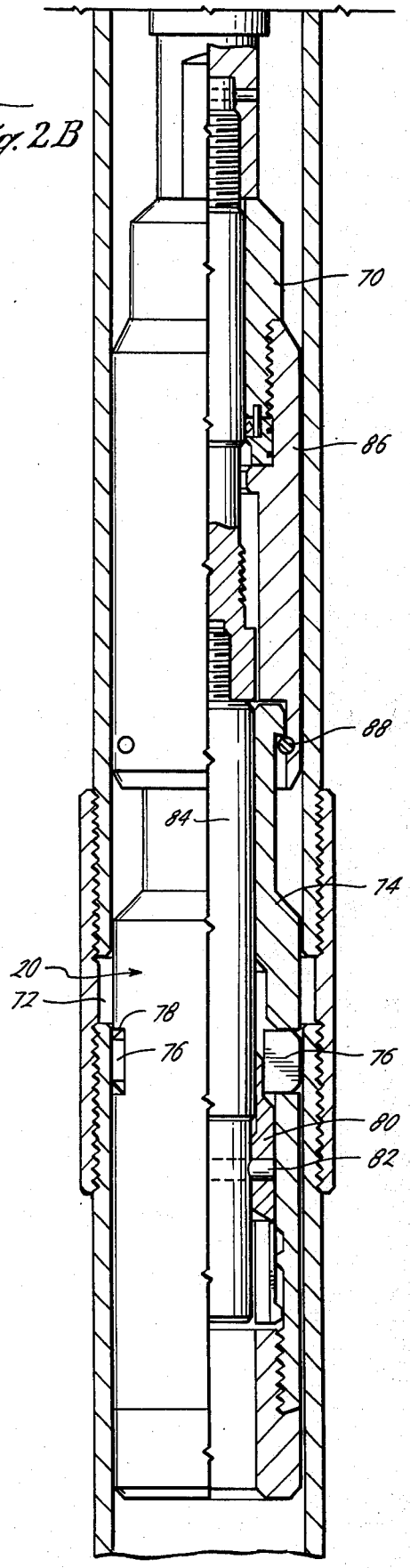

While the present well installation 10 may be used to install and remove types of well apparatus, for purposes of illustration only, the well tool locator 18 is shown in FIGS. 1A, 1B, 2A and 2B as installing a conventional well lock such as a Camco Z-lock 20 which is supported from the well tool 18 by means of a conventional Camco running tool 70. Referring to FIG. 2B, the well lock 20 is desired to be installed in an annular groove 72. As is conventional, the lock 20 includes a body 74, a plurality of dogs 76 which are adapted to be movable through windows 78 in the body and held in place by a locking collet 80 on upward movement of the collet 80 behind the dogs 76 when they are positioned in the groove 72. The collet 80 is initially connected by a shear pin 82 connected to a tubular prong 84 of the running tool 70 which in turn is supported from the well locator 18. The running tool 70 includes a body 86 slidably surrounding the prong 84 and in turn supports the body 74 of the well lock 20 by shear pins 88.

Figure 3A:
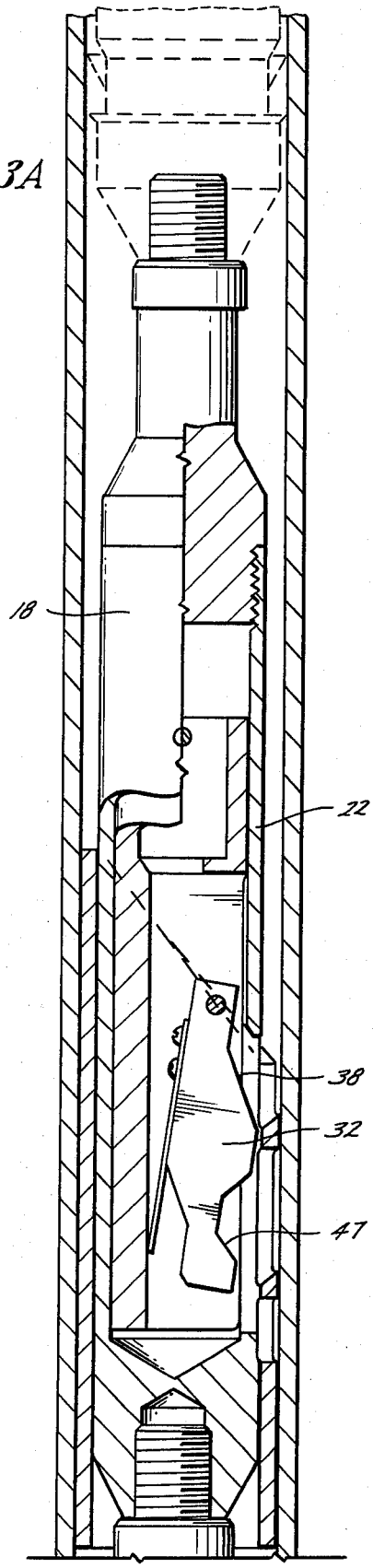
FIGS. 3A and 3B are enlarged elevational views, partly in cross section, of the well installation of FIGS. 2A and 2B with the well apparatus installed in the well tubing, FIG. 4 are fragmentary elevational views of various different coacting configurations of the locating and actuating means of a well locator tool coacting with a well sub.
Figure 3B:
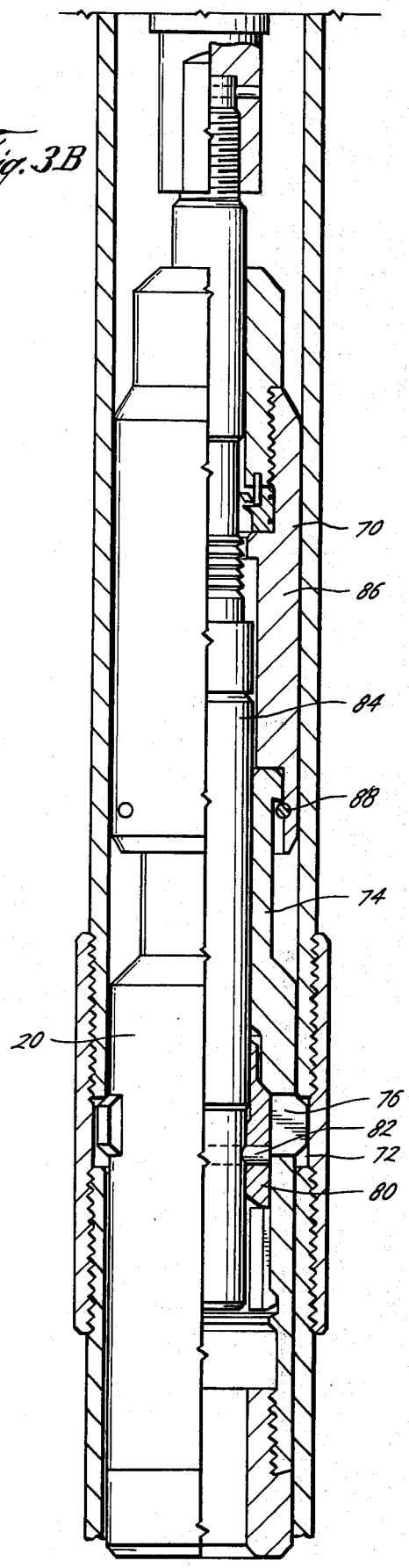

In use, referring to FIGS. 1A, 1B, 2A and 2B, the well locator tool 18 is moved downwardly through the tubing 12 either by wireline or pumpdown operation for installing the well lock 20 in the annular groove 72 below the well sub 16. As the well tool 18 is moved downwardly in the tubing 12, the locator key 32 will engage the guide surface 52*a* of the well sub 14 and move into the slot 54*a*. However, since the coacting configuration on the outer periphery of the well key 32 will not match the configuration of the ridge 58*a* and valley 60 of the sub 14, the downwardly directed actuating shoulder on the key 32 will not engage the upward directing actuating shoulder 56*a* of the sub 14 and the well locator tool 18 will bypass the sub 14. However, when the locator key 32 reaches the sub 16 and moves downwardly on the guide surface 52 and into the slot 54, the coacting ridge 42 and valley 44 of the key 32 will coact with the valley 60 and ridges 58, respectively, of the sub 16 and, as best seen in FIGS. 2A, the actuating shoulder 40 on the key will engage the upwardly directed actuating shoulder 56 of the sub 16. And as best seen in FIG. 2B, at this position the dogs 76 of the well lock 20 will be positioned below the annular groove 72. The stoppage of the well locator tool 18 in the sub 16 can be noted at the surface, either by decrease in tension in a wireline or by an increase in hydraulic pressure and a pump down system, thereby indicating that the tool 18 has been located and positioned in the proper sub 16. The well locator tool 18 is then raised in the tubing 10, and as best seen in FIG. 3B, the dogs 76 will engage the annular groove 72 and further upward movement of the running tool 70 will move the actuating prong 84 upwardly carrying the collet lock 80 upwardly behind, and locking the dogs 76 in place in the groove 72. Further upward movement of the well tool 18 will shear pin 82 releasing the prong 34 from the collet lock 80, and thereafter shear pins 88 are sheared to release the locking dog body 74 from the running tool 86. Further upward movement of the well tool 18 will carry the running tool 70 to the surface leaving the well lock 30 installed in place in the tubing 12 below the well sub 16. It is to be noted that the tapered surfaces 38 and 47 on the outer periphery of the key 32 will allow the well tool 18 to be easily moved up into the well bore as the key 32 will be pushed into the body 22 of the well tool 18 as any shoulder obstructions are encountered.

Referring now to FIGS. 5–8, another embodiment of the present invention is best seen in which the well installation 100 includes a plurality of mandrels, only one of which such as mandrel 116 is shown, positioned in the well bearing 112 in which a kickover tool 118 is adapted to install or remove a flow control device 120 from the mandrel 116.

Each of the mandrels, such as mandrel 116, includes a body 90 having connections at each end as threaded connections 92 and 94 for connecting the mandrel 116 in the tubing 112. The mandrel 116 includes a bore 96 extending therethrough and a pocket 98 for receiving a flow control device. An orienting sleeve 150 is positioned in the mandrel body 90 above the pocket 98 for orienting a kickover tool 118 for suitably aligning the kickover tool 118 relative to the pocket 98 for inserting or removing a flow control device 120. The orienting sleeve 150 includes a downwardly guide surface 152 and a slot 154 extending downwardly from the guide surface 152 for properly orienting the kickover tool 118. An upwardly directed actuating shoulder 156 is positioned adjacent the orienting sleeve 150 for engaging a downwardly actuating shoulder of the kickover tool 118. While the shoulder 156 may be annular and may be positioned above or below the sleeve 150, it is preferable for the reasons given above in connection with the previous embodiment that the shoulder 156 be positioned at the bottom of the slot 154 and be substantially the same width as the slot 154 and in order to provide that the mandrel 116 will selectively accept only a particular kickover tool 118, a configuration is provided adjacent the shoulder 156 of at least one ridge 158 and one valley 160.

In order for the mandrel 116 to be more versatile and to accept a conventional kickover tool such as described in U.S. Pat. No. 3,827,490, as well as the kickover tool 118 of the present invention, the orienting sleeve 150 may include an upwardly extending guide surface 91 at the bottom of the sleeve with a slot 93 extending upwardly from the guide surface 91 and having a stop or actuating shoulder 95 at the top of the slot 93. Therefore, the mandrel 116 will accept a conventional kickover tool as well as the type more fully described hereinafter.

The kickover tool 118 includes a body 122 and means 124, such as a thread connection, for attachment to suitable means, such as a wireline or pumpdown locomotive, here shown as a pumpdown locomotive 126 for moving the tool 118 downwardly and upwardly through the well tubing 112. A locating assembly, generally indicated by the reference numeral 130, is provided longitudinally movable relative to the body 122 and includes a locating finger 132 which is pivotally secured by pin 133 to the assembly 130 and is yieldably urged outwardly through a window 136 in the body 122 by a spring 134. The locating assembly 130 is initially secured to the body 122 by releasing means such as shear pin 131. The key 132 includes a downwardly tapered surface 138 whereby the tool 118 can be moved upwardly through the tubing 112 and the key 132 will be moved inwardly through the window 136 against the spring 134 as it encounters any obstructions in the tubing 112.

A downwardly directing actuating shoulder 140 is provided, preferably on the key 132, for coacting with an upwardly directed shoulder, such as shoulder 156 of the mandrel 116, for actuating the kickover tool 118. In order to provide actuation of the kickover tool 118 in the mandrel 116, a particular configuration of at least one ridge 142 and one valley 144 is provided on the outer periphery of the key 132 adjacent the actuating shoulder 140 which will coact with the ridge 158 and the valley 160 of the mandrel 116. Thus, the selectivity of installing or removing a flow control device 120 from a particular mandrel 116 is provided by coacting configurations between the locator key 132 and the mandrel 116.

If desired, a spring-loaded centralizer 149 is provided on the body 122 opposite the window 136 to insure that the locator key 136 makes a secure engagement with the orienting sleeve 150 and the actuating shoulder 156.

Suitable kickover means, generally indicated by the reference numeral 170, are shown supported from the body 122 such as by threads 172 and includes a kickover arm 174 mounted on a pivot 176 and yieldably urged to a kickover position by suitable means such as a spring 178. A universal joint generally indicated by the reference numeral 180, and more fully described in U.S. Pat. No. 3,891,032, may be provided in the kickover means 170 to allow pivoting of the kickover means 170 relative to the body for allowing the kickover tool 118 to be easily pumped through a curved well tubing. The universal joint 180, while allowing pivoted motion in any direction, maintains the rotational orientation of the kickover arm 174 relative to the locator key 132 for correctly orienting the kickover arm 174 over the pocket 98. This action is provided by the ball joint including slots 181 in one member of the ball joint and pins 182 in the second member. Means are provided for initially holding the kickover arm 174 in the retracted position such as actuator 184 which is connected to the locating assembly 130 such as by threads 186 and in turn extends through the universal joint 180 to hold a floating member 188 downwardly against a pin 190 in the kickover arm 174 for keeping the arm 174 initially in the retracted position.

Figure 5:
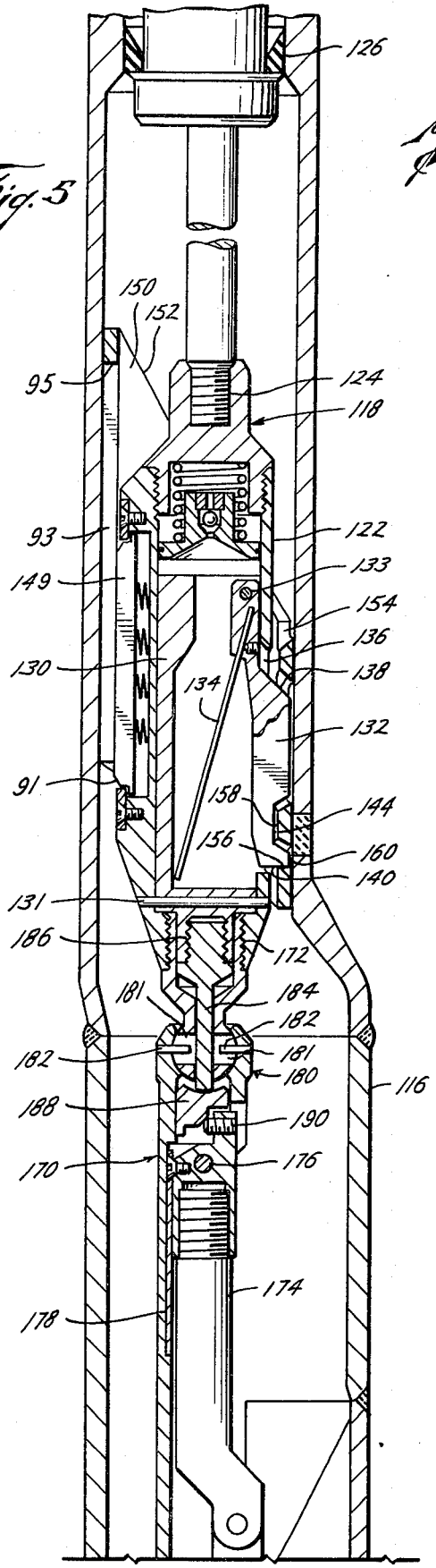
FIG. 5 is an elevational view, in cross section, of the present invention embodied as a mandrel and kickover tool for installing or removing a flow control device from the pocket of the mandrel in which the well locator tool is shown initially engaging the mandrel.
Figure 6:
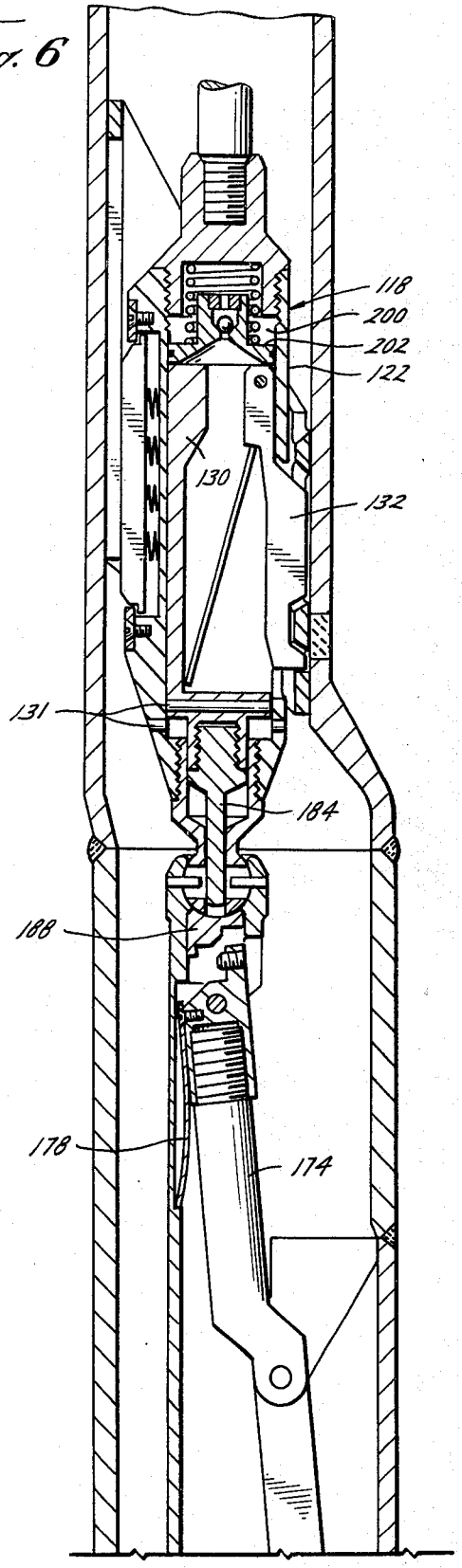
FIG. 6 is a view similar to FIG. 5 in which the well locator tool has moved to a position releasing the kickover tool.

Referring to FIG. 5, and assuming that the kickover tool 118 has been moved downwardly through the well tubing 112 such as by hydraulic pumpdown 126, the kickover tool 118 will bypass any mandrels in the well tubing not having a configuration which will mate with the configuration of the key 132, but upon encountering mandrel 116 with its coacting mating configuration of a ridge 158 and a valley 160 and downwardly directed actuating shoulder 140 will encounter the upwardly actuating shoulder 156 of the mandrel 116. At this position, as shown in FIG. 5, the kickover tool 118 has been oriented by the orientation sleeve 150 to rotatably position the kickover arm 174 to be in position to move outwardly and over the pocket 98. When the kickover tool 118 encounters the upwardly directed shoulder 156, the tool 118 will stop until the shear pin 131 is sheared, as best seen in FIG. 6, at which time the body 122 will move downwardly relative to the locating assembly 130 thereby allowing the floating member 188 to move away from the actuating rod 184 thereby releasing the kickover arm 174 to allow the spring 178 to move the arm 174 outwardly and over the top of the pocket 98.

Figure 7:
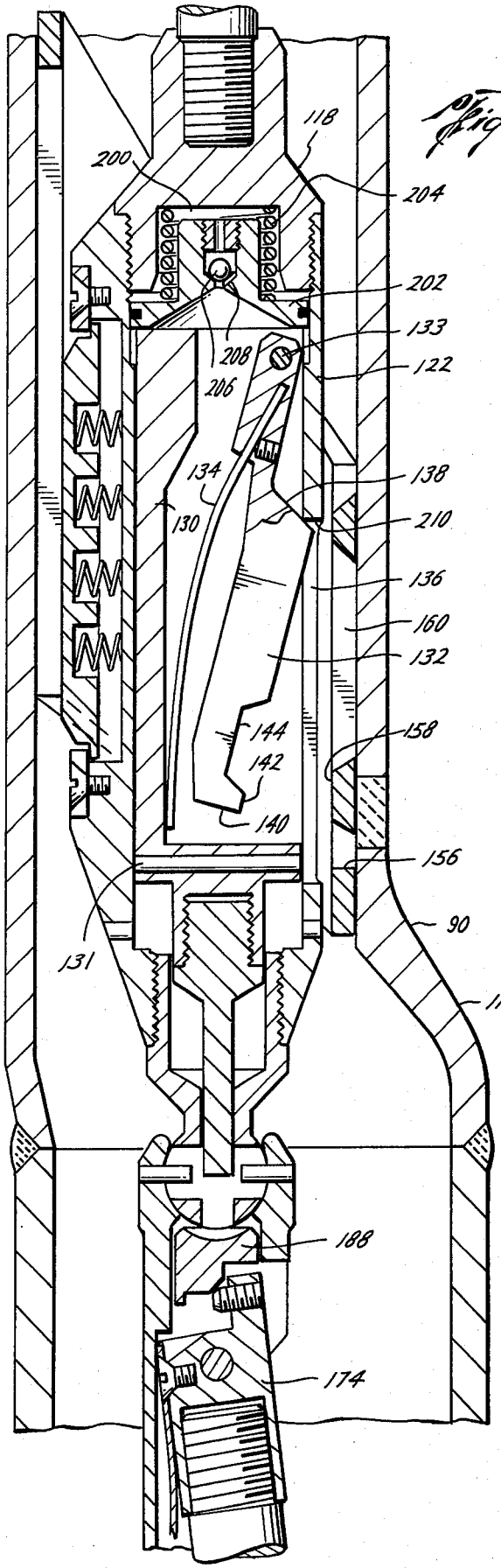
FIG. 7 is a view similar to FIGS. 5 and 6 in which the locator key and actuating shoulder of the locator tool has been retracted whereby the kickover tool may be moved further downwardly towards the pocket of the well mandrel.
Figure 8:
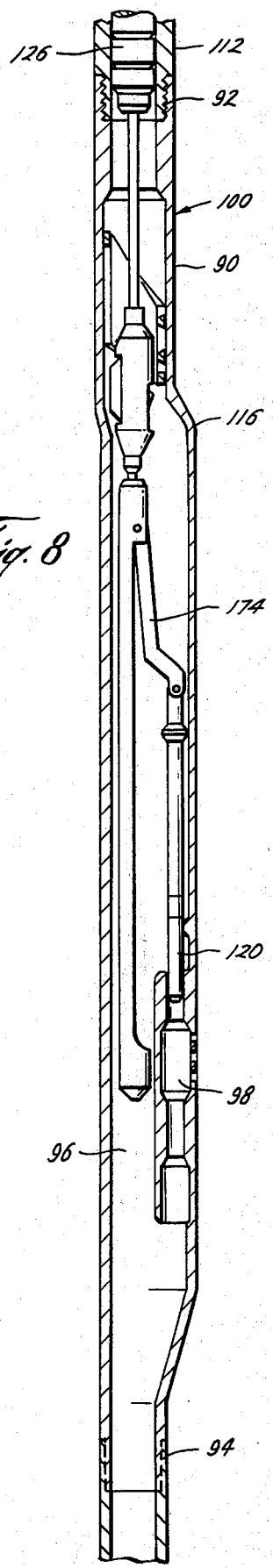
FIG. 8 is an elevational view, partly in cross section, illustrating the insertion of a flow control device into the pocket of the mandrel by the kickover tool of FIGS. 5–7.

However, further downward movement of the body 122 relative to the locating assembly 130, after the shear pin 131 is sheared, is limited by means resisting such longitudinal movement in order to allow the kickover arm 174 to be actuated prior to further downward movement of the kickover tool towards the pocket 98. The yieldable means may include a fluid chamber 200 positioned above the locating assembly 130 and a piston 202 movable in the chamber 200. If desired, the piston 202 may be urged downwardly in the cylinder 200 by a spring 204. A check valve 206 is provided which allows free communication of fluid into the fluid chamber 200 and includes a restricted orifice 208 for limiting the flow of fluid out of the chamber 200 even when the check valve 206 is seated. Thus, as shown in FIG. 6, the body 122 moves downwardly after the shear pin 131 is sheared to release the kickover arm 174, but movement of the body 122 downwardly is stopped when the upper end of the locating assembly 130 engages the bottom of the piston 202 since fluid, from the well bore, will fill the chamber 200. However, with the kickover tool 118 being urged downwardly, fluid will leak out of the chamber 200 through the restricted orifice 208 allowing the body 122 to move downwardly, as best seen in FIG. 7, relative to the piston 202 and locating assembly 130. A retracting shoulder 210 is provided on the body 122 above the window 136 which will engage the downwardly tapered surface 138 on the top of the key 132, but only after pin 131 is sheared and arm 174 is released, to retract the key 132 in through the window 136 and allow the body 122 to move further downwardly. When the downwardly actuating shoulder 140 on the key 132 is moved out of contact with the upwardly actuating shoulder 156 of the mandrel 116, the kickover arm 174 which is now positioned over the pocket 98 will now move directly towards the pocket 98 as the kickover tool 118 is moved further downwardly. The kickover tool 118 will perform its conventional function of installing or engaging a flow control device 120 in the well pocket 98 by downward movement and is conventionally released by reversing the movement of the kickover tool 118. It is noted that the kickover tool 118 has been actuated by a single downward and upward movement, has been oriented into the proper rotational position for installing or removing a flow control device from the pocket, and selectively engages only one of a plurality of mandrels in the well tubing.

The present invention, therefore, is well adapted to carry out the objects and attain the ends and advantages mentioned as well as others inherent therein. While presently preferred embodiments of the invention are given for the purpose of disclosure, numerous changes in the details of construction and arrangement of parts will readily suggest themselves to those skilled in the art and which are encompassed within the spirit of the invention and the scope of the appended claims.

What is claimed is:

1. A well locator tool for coacting with a well sub positioned in a well tubing, said sub having an orientation sleeve having a downwardly extending guide surface on the top of the sleeve, an upwardly directed actuating shoulder on the sleeve, and a slot in the sleeve having a configuration of at least one ridge and one valley, said tool comprising, a body having connection means for moving the tool through a well tubing and including means for supporting well apparatus, actuating means including a finger movably connected to said body for longitudinal movement, and including a well apparatus actuator, said finger including a downwardly directed actuating shoulder for engaging the shoulder in the sleeve, spring means yieldably urging said finger outwardly, releasing means initially preventing longitudinal movement between the body and said finger but allowing movement after being released thereby allowing movement between said body and said actuator, and means allowing but yieldably resisting longitudinal movement between the body and said finger whereby further longitudinal movement of the body, after the releasing means is released, may occur only after movement between said body and said actuator.

2. The apparatus of claim 1 wherein the body includes, a retracting shoulder on the body positioned above the finger which engages said finger and retracts said finger upon downward movement of the body relative to the finger.

3. The apparatus of claim 1 wherein the finger includes, a particular configuration of at least one ridge and at least one valley at its outer periphery which will coact only with a well sub having mating coacting surfaces.

4. The apparatus of claim 1 wherein said yieldably resisting means includes, a fluid chamber between said body and said actuating means, a piston positioned in the fluid chamber, and fluid restricting means in communication with the fluid chamber limiting the flow of fluid from the chamber.

5. A well sub for actuating a well locator tool, said tool having actuating means including a downwardly directed actuating shoulder and an outer periphery having a configuration of at least one ridge and one valley, said sub comprising, a tubular housing, said housing including connecting means for connecting the housing in a well tubing, an orienting sleeve positioned in the housing having a downwardly extending guide surface on the top of the sleeve for orienting the actuating means of a well tool, a recessed slot in the housing, said slot including a distinctive configuration of at least one ridge and at least one valley vertically aligned within said slot which will only accept an actuating means having an outer periphery having a coacting configuration whereby the sub will accept and actuate only a selected well tool, and an upwardly directed horizontally extending actuating stop shoulder vertically aligned in the slot for engaging said downwardly directed actuating shoulder of the well tool, and said slot and upwardly actuating shoulder being of a sufficiently narrow width for preventing annular shoulders from becoming engaged in said slot and on said upwardly directed shoulder.

6. A well sub for connection in a well tubing for actuating a well locator tool, said tool having actuating means including a downwardly directed actuating shoulder and an outer periphery having a configuration of at least one ridge and one valley, said sub comprising, a tubular housing having connecting means for connecting the housing in a well tubing, an orientation sleeve positioned in the housing having a downwardly extending guide surface on the top of the sleeve, and a slot extending downwardly from the guide surface for orienting the actuating means of a well tool, said slot including a distinctive configuration of at least one ridge and at least one valley vertically aligned within said slot which will only accept an actuating means having an outer periphery having a coacting configuration whereby the sub will accept and actuate only a selected well tool, an upwardly directed horizontally extending actuating stop shoulder vertically aligned within said slot for engaging said downwardly directed actuating shoulder of the well tool, said shoulder having substantially the same width as the slot, and said slot being of a sufficiently narrow width for preventing annular shoulders moving through the well tubing from becoming engaged in said slot and on said shoulder.

7. A mandrel for connection in a well tubing for actuating a kickover tool for running or retrieving a flow control device, said tool having actuating means including a downwardly actuating shoulder and an outer periphery of at least one ridge and at least one valley, said mandrel comprising, a mandrel body having a connection at the top and bottom for connection in the well tubing, a bore in said body extending between the tubing connections, a pocket in the body for receiving a flow control device, orientation means in the mandrel body in said bore for orienting a kickover tool on downward movement of the kickover tool through the mandrel, said orienting sleeve having a downwardly extending guide surface on the top of the sleeve, a recessed slot in the mandrel, said slot including a distinctive configuration of at least one ridge and at least one valley vertically aligned within said slot which will only accept a kickover tool actuating means having an outer periphery having a coacting configuration whereby the sub will accept and actuate only a selected kickover tool, an upwardly directed horizontally extending actuating stop shoulder vertically aligned in the slot for engaging said downwardly directed actuating shoulder of the kickover tool, and said slot and upwardly directed actuating shoulder being of a sufficiently narrow width for preventing annular shoulders moving through the well tubing from becoming engaged in said slot and on said shoulder.

8. The apparatus of claim 7 including, an upwardly extending guide surface on the bottom of the sleeve, a second slot extending upwardly from the upwardly extending guide surface for orienting a kickover tool on upward movement, and a downardly directed actuating shoulder at the top of the second slot.

9. A mandrel for connection in a well tubing for actuating a kickover tool for running or retrieving a flow control device, said tool having an actuating means including a downwardly actuating shoulder and having an outer periphery of at least one ridge and at least one valley, said mandrel comprising, a mandrel body having a connection at the top and bottom for connection to the well tubing, a bore in said body extending between the tubing connections, a pocket in the body for receiving a flow control device, orientation means positioned in the body for orienting a kickover tool on downward movement of the kickover tool through the mandrel, said orienting means having a downwardly extending guide surface on the top of the sleeve, and a slot extending downwardly from the guide surface for orienting a kickover tool, said slot including a distinctive configuration of at least one ridge and at least one valley vertically aligned within said slot which will only accept an actuating shoulder having an outer periphery having a coacting configuration whereby the mandrel will actuate only a selected kickover tool, an upwardly directed horizontally extending actuating stop shoulder vertically aligned within said slot for engaging a downwardly actuating shoulder of a kickover tool, said shoulder being substantially the same width as the slot, and said slot being of a sufficiently narrow width for preventing annular shoulders passing through the well tubing from becoming engaged in said slot and on said upwardly directed shoulder.

10. A kickover tool for installing or removing a flow control device from a pocket of a well mandrel, said mandrel having an orienting sleeve having a downwardly extending guide surface, a slot extending downwardly from the guide surface and an upwardly directed actuating shoulder on the sleeve, said tool comprising, a body having connection means for moving the tool through a mandrel, finger means longitudinally movable relative to the body, spring means yieldably urging said finger outwardly, said finger means including a downwardly directed actuating shoulder for coacting with the guide surface and with said upwardly directed shoulder of the mandrel, releasing means initially preventing longitudinal movement between the body and said finger means but allowing such movement after being released, kickover means including a flow control handling device connected to and supported by the body, spring means for laterally moving said kickover means, means connected between the kickover means and said finger means initially holding said kickover means aligned with the body, coacting means between said body and said finger means for retracting said finger means for allowing the tool to move downwardly after the kickover means is actuated, and means allowing but yieldably resisting longitudinal movement between the body and the finger means whereby extended longitudinal movement of the body after the releasing means is released may occur only after said kickover means has been released.

11. The apparatus of claim 9 wherein said yieldably resisting means includes, a fluid chamber between said body and said finger means, a piston positioned in the fluid chamber, and fluid restricting means in communication with the fluid chamber limiting the flow of fluid from the chamber.

12. A well installation for installing or removing a flow control device from a pocket in a selected mandrel by a kickover tool by a single reciprocating movement comprising, a mandrel having a body, a bore in the body extending through the body, a pocket in the body for receiving a flow control device, orientation sleeve means in the mandrel body having a downwardly extending guide surface on the top of the sleeve, and a slot extending downwardly from the guide surface for orienting a kickover tool, said slot including a distinctive configuration of at least one ridge and at least one valley vertically aligned within said slot which will only accept an actuating finger means having an outer periphery having a coacting configuration whereby the mandrel will actuate only a selected kickover tool, an upwardly directed horizontally extending actuating stop shoulder vertically aligned within said slot for engaging a downwardly actuating shoulder of a kickover tool, said upwardly directed shoulder being substantially the same width as the slot, said slot being of a sufficiently narrow width for preventing annular shoulders from becoming engaged in said slot and on said shoulder, and a kickover tool comprising, a body having connection means for moving said tool through the mandrel, actuating finger means longitudinally movable relative to the body, spring means yieldably urging said finger means outwardly, releasing means initially preventing longitudinal movement between the body and said finger means but allowing said movement after being released, kickover means including a flow control handling device connected to and supported by the body, means connected between the kickover means and said finger means initially holding said kickover means aligned with the body but releasing said kickover means when the body is moved relative to the finger means, spring means for laterally moving said kickover means, said finger means including a downwardly directed actuating shoulder for engaging the upwardly directed actuating shoulder of said mandrel, and the outer periphery of said finger means including a configuration of at least one ridge and at least one valley which coacts with the configuration of said mandrel whereby the downwardly directed shoulder will engage the upwardly directed actuating shoulder of said mandrel, coacting means between said body and said finger means for retracting said finger means for allowing the tool to move downwardly after the kickover means is actuated, and means allowing but yieldably resisting longitudinal movement between the body and finger whereby further longitudinal movement of the body, after the releasing means is released, may occur only after said kickover means has been released.

* * * * *

UNITED STATES PATENT OFFICE

CERTIFICATE OF CORRECTION

PATENT NO. : 4,002,203

DATED : January 11, 1977

INVENTOR(S) : Ben David Terral

It is certified that error appears in the above-identified patent and that said Letters Patent are hereby corrected as shown below:

Column 3, line 59, change "at" to --as--

Column 6, line 59, after "will" insert --shear--

Column 6, line 60, change "34" to --84--

Column 6, line 62, after "tool" insert --body--

Column 6, line 64, change "30" to --20--

Column 7, line 7, delete "bearing" and insert --tubing--

Column 7, line 11, after "end" insert --such--

Column 7, line 48, change "thread" to --threaded--

Column 8, line 26, after "body" insert --122--

Column 8, line 49, delete "and" and insert -- the --.

Column 8, line 51, after "wardly" insert --directed--

Column 14, line 32, after "finger" insert --means--

Signed and Sealed this

Fourteenth Day of June 1977

[SEAL]

*Attest:*

RUTH C. MASON
*Attesting Officer*

C. MARSHALL DANN
*Commissioner of Patents and Trademarks*